United States Patent [19]

Shaw

[11] Patent Number: 4,480,874

[45] Date of Patent: Nov. 6, 1984

[54] RETAINER DEVICE FOR AUGER, ROOF AND THE LIKE TYPE BITS

[76] Inventor: Ray H. Shaw, 557 E. 305th St., Willowick, Ohio 44094

[21] Appl. No.: 302,800

[22] Filed: Sep. 16, 1981

[51] Int. Cl.[3] ..... E21B 10/46

[52] U.S. Cl. ..... 299/91; 175/410

[58] Field of Search ..... 299/79, 91, 92, 93, 299/94; 175/410, 411, 414, 418; 407/118; 76/108 A

[56] References Cited

U.S. PATENT DOCUMENTS

| | | | |
|---|---|---|---|
| 2,308,569 | 7/1941 | St. Clair | 407/118 |
| 3,434,554 | 3/1969 | Bower, Jr. | 175/410 |
| 3,576,060 | 4/1971 | Stein | 407/118 |
| 3,671,075 | 6/1972 | Eyre et al. | 299/79 |
| 4,356,873 | 11/1982 | Dziak | 175/410 |

FOREIGN PATENT DOCUMENTS

| | | | |
|---|---|---|---|
| 0001327 | 3/1931 | Australia | 407/118 |
| 0664983 | 6/1950 | United Kingdom | 175/410 |

*Primary Examiner*—Stephen J. Novosad
*Assistant Examiner*—William P. Neuder
*Attorney, Agent, or Firm*—Watts, Hoffmann, Fisher & Heinke Co.

[57] ABSTRACT

A retainer device of the type for securing by brazing or the like a carbide cutter element to a drill bit body of the auger and roof type. The retainer device includes a unitary, one-piece body made from a consumable, non-ferrous brazing material defined by a base portion and an integral upstanding wing portion adapted to be disposed within a correspondingly shaped recess portion formed in the head of the tool bit. The retaining device is adapted to mount a carbide cutter element such that the cutter element is secured by brazing within the recess portion with the cutter element being exposed for a majority of its area for cutting operations.

12 Claims, 8 Drawing Figures

RETAINER DEVICE FOR AUGER, ROOF AND THE LIKE TYPE BITS

DESCRIPTION

1. Technical Field

The present invention relates to drill bits and more specifically to a retainer device and system for mounting a carbide cutter element in drilling operations, such as in roof drilling operations in coal mines or the like. The retainer system of the present invention is utilized with bits specifically of the auger and roof type. The subject of the present application relates generally to the retainer device and system disclosed in applicants co-pending application entitled "Retainer Device for Drill Bit" filed in the name of Ray H. Shaw.

2. Background Art

Heretofore, it has been known in the drilling field to utilize bits that employ a carbide cutter element that is ordinarily fixed to the body of the bit by brazing or the like. In such prior bits a generally U-shaped clip or shim made of a non-ferrous metal, such as copper, has been inserted between the cutter element (carbide) and the bit body so that the legs of the equipment are bent between the plane or the sides of the cutting element and the side surfaces defined by a transverse slot formed in the drill body. Accordingly, during the fabrication operation, the clip or shim is brazed to the bit body so as to fuse the carbide element to the bit body. In such application, a brazing material, such as a brazing rod element, is utilized to braze the clip or shim to the bit body.

In order to maximize cutting or drilling efficiency, it has been found that the center line of the carbide cutter element should be coincident with the rotational axis of the bit body. Heretofore, in the prior art clips, there was not a construction which enabled accurate alignment between such cutter element and the bit body. Centering of the component parts was accomplished during assembly by the workmen which required a great amount of time and effort by reason of the requirement to handle relatively small component parts under adverse conditions. More specifically, in such applications the carbide cutter element was aligned during the brazing operation by manually tapping the side of the element until it finally appeared to be aligned with the bit body. This was conventionally achieved by the workmen visually aligning the component parts. This was a tedious task which was required to be done while the component parts were heated to a relatively high temperature and hence, was basically a trial and error operation, dependant upon the relative skill and patience of the workmen.

DISCLOSURE OF THE INVENTION

The present invention provides a new and improved retainer device and system for securing a cutter element (i.e., carbide) to a bit body in the form of an auger or roof type bit. In the invention, a retainer device is provided that operates to automatically center the carbide cutter element within a transverse recess formed in the bit body and maintains axial alignment of the component parts during the brazing operation until the brazing alloy liquid temperature is reached. Accordingly, the present invention obviates the need for highly skilled workmen without sacrificing quality of construction of the finished tool bit. More specifically, in the invention the retaining device (shim) is made from a consumable, non-ferrous metallic material which provides the brazing material for securement of the component part. In effect, the carbide cutter element is automatically secured without the need to employ separate brazing rods, brazing pastes, or the like.

In a preferred embodiment, the retainer device includes a unitary, one-piece body made from a consumable, non-ferrous brazing material such as copper. The body includes a base portion and an integral, upstanding wing portions which together define a generally L-shaped configuration. The base and wing portions together define a seat adapted to receive and support the carbide cutter element with the two pieces then inserted, as a unit, into a corresponding recess or cut-out portion provided adjacent the digging end of the bit body. In various embodiments of the retainer device, integral tab portions extend outwardly from the respective base and wing portions for co-acting engagement with the bit body and carbide cutter element to prevent lateral shifting movement of the retainer device, and hence the carbide cutter element during the brazing operation. Accordingly, the present invention provides a retainer device that not only serves as a means for locating and maintaining the alignment of the carbide cutter element relative to the bit body during the attachment process, but also the device itself is made from a consumable non-ferrous brazing material that enables, in effect, the carbide cutter element to be secured, in situ, without the need for ancillary brazing rods, paste or the like. Further, the device enables the cutter element to be positioned such that a maximum area (i.e., three sides) are exposed to the work area.

Additional and further advantages of the invention will be made more apparent as the following description proceeds in connection with the accompanying drawings and claims thereof.

BEST MODE FOR CARRYING OUT THE INVENTION

Figure 1:
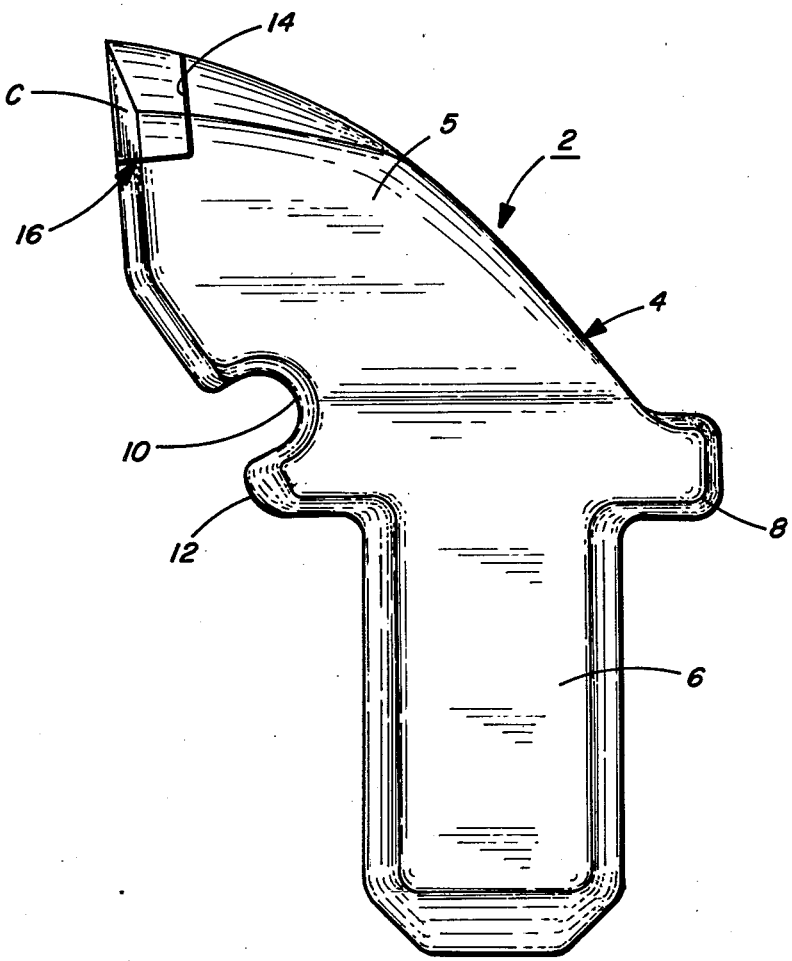
FIG. 1 is a side elevation view illustrating an auger-type bit utilizing the retainer device of the invention for mounting a carbide cutter element.

Referring now to the drawings and in particular to FIG. 1 thereof, there is illustrated an auger-type bit, designated generally at 2, which is made from a metallic material such as steel. The bit 2 includes a body 4, head 5 and an integral shank 6 which is adapted to be detachably mounted within a socket in a support block (not shown) in a manner as known in the art. The shank has a rear abutment 8 which acts as a stop when the bit shank is inserted within the socket of the mounting block. The head has a front abutment 12 and a pry-out notch 10 for removing the tool bit from the mounting block, as known in the art. For example, similar type bits are illustrated in U.S. Pat. No. 3,114,537.

Figure 3:
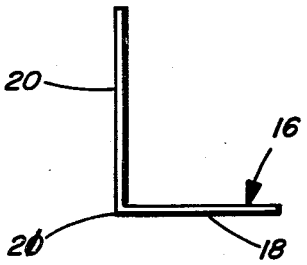
FIG. 3 is an end elevation view of one form of the retainer device made in accordance with the present invention.
Figure 4:
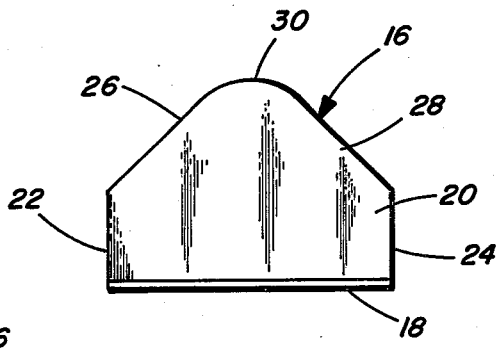
FIG. 4 is a side elevation view of the retainer device illustrated in FIG. 3.
Figure 5:
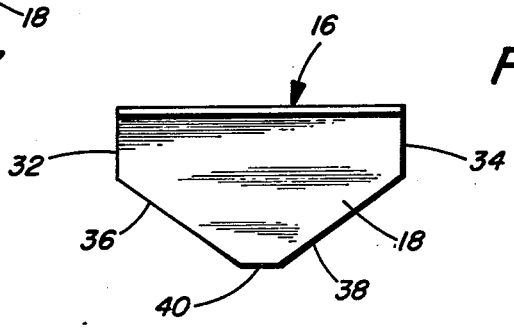
FIG. 5 is a top plan view of the retainer device illustrated in FIG. 4.
Figure 2:
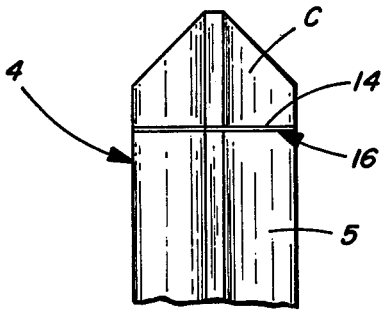
FIG. 2 is a fragmentary, front elevation view of the bit body illustrated in FIG. 1.

Now in accordance with the invention, in FIGS. 3, 4 and 5 there is illustrated one form of a retainer device, designated generally at 16, for securing a carbide cutter element, designated generally at C, to the tool bit 2, as illustrated in FIGS. 1 and 2. In the embodiment illustrated, the device 16 includes a generally planar base portion 18 and integral upstanding wing portion 20 which are joined together by a bight portion 21. The base portion includes oppositely disposed, parallel side edges 32 and 34 and inclined end edges 36 and 38 which terminate in a front edge portion 40 which extends parallel to the wing portion 20. Preferably, the base 18 and wing portions 20 are disposed at right angles in respect to one another to define the generally L-shaped configuration illustrated in FIG. 3. The wing portion 20 has a pair of oppositely disposed parallel side edge portions 22 and 24 and upwardly and inwardly inclined top edges 26 and 28 which merge into a curved top portion 30. Accordingly, the retainer device 16 is inserted within a corresponding generally L-shaped recess 14 which is cut or formed out of the material of the head portion 5 of the bit so as to receive therein the carbide cutter element C. Moreover, the recess 14 is shaped so as to accommodate the contour of the carbide cutter element C which provides the cutting or working end of the tool bit.

Figure 6:
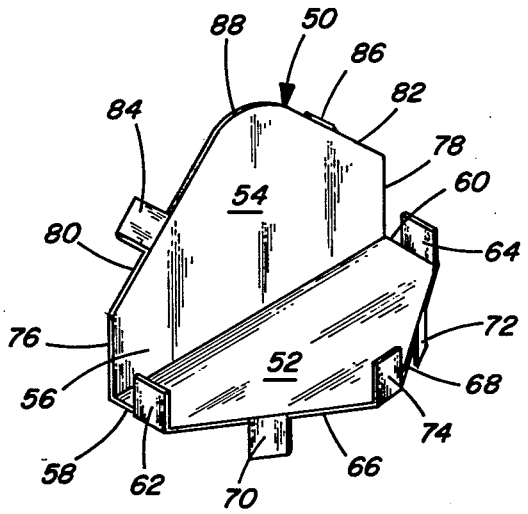
FIG. 6 is a generally perspective view illustrating another modified form of the retainer device made in accordance with the present invention.

In FIG. 6 there is illustrated another modified form of the retainer device, designated generally at 50, made in accordance with the invention. In this form, the device includes a generally flat base portion 52 and an integral upstanding flat wing portion 54. The base portion 52 includes a pair of oppositely disposed, parallel side edges 58 and 60 and a pair of outwardly and inwardly inclined end edges 66 and 68 which merge into a tab portion 74 that extends upwardly and parallel to the wing portion 54. The base portion 52 includes a pair of integral upstanding tab portions 62 and 64 and the edge portions 66 and 68 include the pair of integral, downwardly extending tab portions 70 and 72 with the tab portions 74 extending upwardly in the same direction as the tab portions 62 and 64 for preventing lateral shifting movement of the carbide cutter element in the installed position thereof. The tab portions 70 and 72 coact with the confronting outer surface of the head portions of the tool bit so as to prevent lateral shifting movement of the retainer device relative to the tool bit.

The wing portion 54 includes a pair of oppositely disposed, parallel side edges 76 and 78 and upwardly and inwardly inclined top edges 80 and 82 which merge in a curved top end portion 88. The wing portion has a pair of outwardly extending tab portions 84 and 86 which coact with the confronting surfaces of the head portion 5 of the tool bit to prevent lateral shifting movement of the retaining device in the installed position thereof.

Figure 7:
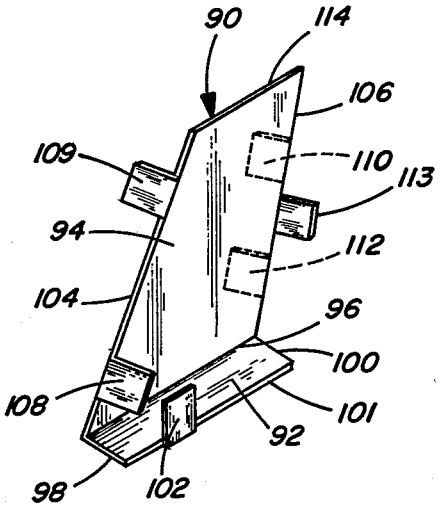
FIG. 7 is a generally perspective view illustrating a further modified form of the retainer device made in accordance with the present invention.

FIG. 7 illustrates a further modified form of the retainer device, designated generally at 90, made in accordance with the invention. In this form, the device includes a generally flat base portion 92 and an upstanding wing portion 94. The base portion 92 has oppositely disposed, parallel side edges 98 and 100 and a front edge 101 which extends parallel to the wing portion 94. In this form, the base portion may have one or more upstanding tab portions 102 which operates to restrict lateral shifting movement of the carbide cutter element in the installed position thereof.

In this form, the wing portion 94 is of a pyramidal configuration defined by upwardly and inwardly inclined side edges 104 and 106 and a horizontally extending top edge 114. Hence, this provides a truncated pyramid with equal sides 104, 106. In this form, the wing portion has outwardly extending tab portions 109, 110 and 112 on one side and 108 and 113 on the opposite side which cooperate with the carbide cutter element and the confronting exposed surfaces of the head of the tool bit to prevent lateral shifting movement of the retainer and hence the carbide element in relation to the head of the bit.

Figure 8:
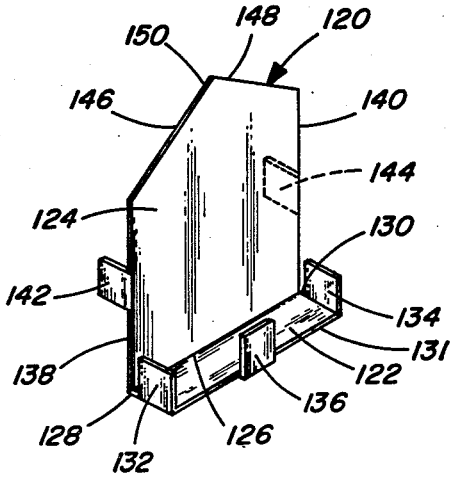
FIG. 8 is a generally perspective view illustrating still a further modified form of the retainer device made in accordance with the present invention.

In FIG. 8, there is illustrated a still further modified form of the retainer device, designated generally at 120, made in accordance with the invention. In this form, the device includes a generally planar base portion 122 with oppositely disposed parallel side edges 128, 130 and a front edge 131 which extends parallel to the wing portion 124. The base portion includes tab portions 132, 134 and 136 which function to retain in position the carbide cutter element.

In this form, the wing portion 124 includes a pair of oppositely disposed, parallel side edges 138, 140 and inwardly and upwardly inclined top edges 146, 148 which merge into a pointed terminal edge 150. The wing portion is provided with a pair of oppositely disposed outwardly extending tab portions 142 and 144 adapted for engagement with the exposed confronting outer surfaces of the head of the tool bit to prevent lateral shifting of the retainer device when in the installed position with the recess portion 14 provided in the head 5 of the tool bit.

In the invention, it is preferred that the retainer device be made of a unitary, one-piece construction from a consumable, non-ferrous material which provides a brazing material for permanently securing the carbide element to the drill bit member. Preferably, in the invention, the retainer device is made from a non-ferrous brazing material having as a major constituent a non-ferrous metallic material, such as copper. Preferably, the non-ferrous material has a melting temperature of approximately 1,700° F. and a hardness of between about R15T43 or RB71 and R15T79 or RB97. Now in the invention, a typical example of a suitable composition would be, as follows:

EXAMPLE I

| | |
|---|---|
| Copper | 46–50 |
| Nickel | 9–11% |
| Lead | .05% |
| Aluminum | .01% |
| Phosphorous | .25% |
| Silicon | .04–.25% |
| Zinc | Balance |

From the various modifications illustrated in the foregoing description and illustrated in the accompanying drawings, it will be seen that the retainer device of the invention can be made in various structural designs without departing from the spirit and scope of the present invention. Accordingly, such modification are presented to illustrate the various design types that are contemplated by the present invention.

I claim:

1. A retainer device of the type to be mounted within a recess portion provided in the head of a tool bit, said retainer device comprising a body made from a consumable, non-ferrous metallic brazing alloy adapted, upon heating, to attach the cutting element to the head of the tool bit without the addition of brazing material, said body including a base portion and an integral upstanding wing portion, and said base and wing portion defining a seat to receive a carbide cutter element disposed therein.

2. A retainer device in accordance with claim 1, wherein:

said base and wing portions are of a flat configuration disposed at right angles to one another so as to define a L-shaped configuration in side elevation.

3. A retainer device in accordance with claim 2, wherein:

said base and wing portions are provided with at least one tab portion extending outwardly therefrom adapted to prevent lateral shifting movement of said retainer device relative to the recess portion in said tool bit.

4. A retainer device in accordance with claim 1, wherein:

said body is made from a copper alloy composition.

5. A retainer device in accordance with claim 1, wherein:

said base and wing portions are of the same size and shape, and each having integral tab portions extending outwardly therefrom.

6. A retainer device in accordance with claim 1, wherein:

said base and wing portions are of substantially the same size and shape, and each of said base and wing portions including at least one pair of laterally spaced integral tab portions extending outwardly therefrom for holding engagement with the head of the tool bit and the carbide cutter element in the installed position thereof.

7. A retainer device in accordance with claim 1, wherein:

said base and wing portions are of a generally flat configuration disposed at right ends to one another being made from a copper alloy composition.

8. A retainer device in accordance with claim 1, wherein:

the head of said tool bit being made from steel with said retainer device being made from a copper alloy composition having a major amount of copper and a lower amount of nickel.

9. A retainer device in accordance with claim 1, wherein:

the non-ferrous material has a melting temperature of approximately 1700° F.

10. A retainer device in accordance with claim 1, wherein:

the non-ferrous material has a hardness of between about R15T43 and R15T79.

11. A retainer device in accordance with claim 1, wherein:

the non-ferrous material has a hardness of between about RB71 and RB79.

12. A retainer device in accordance with claims 10 or 11 wherein the non-ferrous material has a melting temperature of approximately 1700° F.

* * * * *